United States Patent [19]

Hehr et al.

[11] Patent Number: 4,742,856

[45] Date of Patent: May 10, 1988

[54] GROOVE FORMING APPARATUS AND METHOD

[75] Inventors: Kenneth L. Hehr, Ferndale; Ronald J. Morgan, Bellingham, both of Wash.

[73] Assignee: The Thumbnail Company, Bellingham, Wash.

[21] Appl. No.: 67,278

[22] Filed: Jun. 26, 1987

[51] Int. Cl.[4] ..... B27C 5/02

[52] U.S. Cl. ..... 144/371; 144/84; 144/134 D; 144/353; 144/136 C; 409/182

[58] Field of Search ..... 144/82, 84, 134 R, 134 D, 144/136 R, 136 C, 353, 371; 409/182

[56] References Cited

U.S. PATENT DOCUMENTS

| | | | |
|---|---|---|---|
| 722,197 | 3/1903 | Schneider . | |
| 1,700,683 | 1/1929 | Madsen . | |
| 2,455,097 | 11/1948 | Scianna . | |
| 2,702,569 | 2/1955 | Yelle | 144/134 D |
| 2,864,414 | 12/1958 | Mazzola . | |
| 2,917,089 | 12/1959 | Ennis . | |
| 3,251,388 | 5/1966 | Ennis . | |
| 3,604,483 | 9/1971 | Nissen . | |
| 3,955,607 | 5/1976 | Roche . | |
| 4,133,361 | 1/1979 | Martinu . | |
| 4,448,572 | 5/1984 | Gill . | |
| 4,542,776 | 9/1985 | Kehoe . | |
| 4,561,478 | 12/1985 | Fields . | |
| 4,593,735 | 6/1986 | Wirth, Jr. . | |

*Primary Examiner*—W. Donald Bray
*Attorney, Agent, or Firm*—Darby & Darby

[57] ABSTRACT

A machine to cut grooves in the mitred end portions of frame members of a picture frame, so that connectors can be inserted in these grooves and join the members to form the picture frame. A base structure mounts a pair of frame members spaced from one another, and a motor with a router bit is positioned with the bit between the frame membersd, with the motor and bit being moved laterally in opposite directions to form the grooves.

20 Claims, 5 Drawing Sheets

GROOVE FORMING APPARATUS AND METHOD

BACKGROUND OF THE INVENTION (a) Field of the Invention

The present invention relates to a method and apparatus for forming grooves, and more particularly to forming grooves in the mitred ends of frame members, such as picture frame members, to enable these frame members to be easily joined together by fasteners to form the completed frame.

(b) Background of the Invention

Picture frames commonly have a rectangular configuration and are formed by four straight frame members which join to one another at mitred ends thereof. A common method of joining the frame members to one another is to apply glue or some other bonding agent to the mitred surfaces, place the surfaces against one another in the desired configuration, and then clamp the frame members together in that configuration for a period of time.

To enable the joining process to be carried out more effectively, there have been various proposals in the prior art to form the mitred ends of the frame members with slotlike grooves or recesses which can receive fasteners of various configurations. Then, the mitred ends of the frame members can be positioned against one another, with the fastening members being inserted in the matching grooves or recesses to hold the frame members together.

These grooves or recesses must be formed with reasonable precision, and to enable these grooves to be formed efficiently, there have been proposals in the prior art to provide machines specially made to form such grooves in the mitred ends of these frame members. Also, there exists in the prior art other types of machines to form slots or grooves in various members, such as doors, panels, etc. A search of the patent literature has disclosed a number of these devices, and these are listed below.

U.S. Pat. No. 4,593,734—Wallace, discloses a frame routing apparatus where the two frame members are held in a base member which can be moved laterally relative to a router. The mitred ends of the frame members face upwardly and rearwardly. A router is mounted between the mitred ends of the frame members and as the base is moved from one side to the other, the recesses or grooves are formed in the mitred ends of the frame members. Suitable stop members are also provided.

U.S. Pat. No. 4,653,557—Merrill, shows a slot cutting machine for forming the recess shown in FIGS. 4, 5 and 6 of that patent. The frame member to be cut is secured to a carriage-like device and slid into a rotating fixed cutter 44 to form the recess.

U.S. Pat. No. 4,632,160—Wright, shows a molding routing apparatus where the molding is mounted to a fixed base in a manner that the position of the molding ca be adjusted laterally. There are a pair of motors carrying routing devices that can be moved into the molding to form the desired recesses.

U.S. Pat. No. 4,615,654—Shaw, shows a portable router used for cutting slots in the edge of a cabinet door to receive the wings of hinges. There is a frame which rests on the door when the slot is cut, and it is located on the door by a selected one of two guides.

U.S. Pat. No. 4,112,987—Pachnik, shows a "radius router guide" where the router is mounted to a frame that is, in turn, mounted to the end of a timber. The frame is pivotally mounted so that the router can be moved in an arcuate path over an end portion of the timber, and also be moved laterally back and forth in a frame. Thus, a circularly curved end surface can be formed on the timber.

U.S. Pat. No. 3,692,075—White, shows a routing tool where the router is movable to form hinge slots in doors or the like. The material to be cut is held in a fixed position, and the router is moved to make the cut. Three different forms of the invention are shown, and in the first embodiment, adjustable stop members are provided to position the workpiece at different locations.

U.S. Pat. No. 3,643,713—Massetani, shows a machine to manufacture grooves in folding elements and doors or the like, and there is an endless tape carrying cutting elements, with this tape being mounted on a pair of wheels.

U.S. Pat. No. 3,547,171—Jacumin, shows a woodworking tool where the wood is moved relative to several cutting tools, including a routerlike device.

U.S. Pat. No. 2,929,421—Webb, shows a machine tool in which there is a work carrier 28, which is supported on a rod 24. The support member is located on the rod 24 by springs 25 and 27 so that the support is held centered.

U.S. Pat. No. 2,630,151—Turnbull, shows a router support means in which there is a support 30 on which the router both tilts and slides. The router movement is limited by a series of adjustable stops.

U.S. Pat. No. 2,354,639—Seymour, simply shows a cutter for forming a groove having an expanded interior portion.

U.S. Pat. No. 1,895,054—Steinmeyer, shows a woodworking machine which is clamped to a sash frame or the like. The router is moved along guide means to cut grooves and the like in the work.

U.S. Pat. No. 1,814,702—Jensen, shows a machine for forming "T" shaped grooves in wood. The major axis of the groove is cut with a sawblade, and the cross is formed by a fixed blade 36.

SUMMARY OF THE INVENTION

The apparatus of the present invention is arranged to form grooves in a pair of first and second frame members, each of which has a mitred end with an end surface slanted at an acute angle to a lengthwise axis of the frame member. The apparatus has a longitudinal axis, a lateral axis, a vertical axis, a front end and a rear end.

There is a base structure having an upwardly facing and laterally facing locating surface means defining first and second operating locations where the first and second frame members can be located to be in contact with the surface means so as to position the frame members relative to the vertical and lateral axes. The end surfaces of the frame members are at forward locations, facing upwardly and forwardly, with the frame members being spaced from one another by a predetermined lateral spacing distance.

There is a positioning means mounted proximate to the forward end of the base structure to engage the end portions of the frame members so as to locate the frame members along the longitudinal axis at the operating locations.

A groove forming motor assembly is provided, this comprising a motor and a bit member. The bit member is mounted to the motor for rotation about an operating axis slanting downwardly and forwardly, generally perpendicular to a plane occupied by the end surfaces of the frame member.

There is a mounting frame having a laterally oriented slide mounting means to which the motor assembly is mounted for lateral movement in either direction from a middle location. The motor assembly is characterized in that when the motor assembly is at the middle location, the bit member is positioned between the end portions of the frame members when in their operating positions.

Spring means is operatively engaged between the frame member and the motor assembly to yieldingly hold the motor assembly in the middle position, and move the motor assembly back to the middle position after lateral displacement of the motor assembly. The mounting frame is adjustably mounted to the base structure for positional adjustment along an adjustment axis extending upwardly and rearwardly at the front end of the base structure.

Thus, the first and second frame members can be placed on the base structure at the first and second operating locations, with the motor assembly being centrally positioned. The motor assembly can then be moved laterally from the center position to form the grooves in the frame members.

In the preferred configuration, the motor has a downwardly and rearwardly extending motor axis, and the motor is mounted to the mounting frame so as to be adjustable along the motor axis. The motor assembly comprises handle means adapted to be grasped manually and moved laterally to move the motor assembly from the middle postion.

The particular configuration of the mounting frame is such that it has laterally spaced side plates between which the slide mounting means is positioned. The motor is positioned between the side plates, and the spring means comprises compression spring members positioned on opposite sides of the motor and between the side plates.

Also, in the preferred form, there are selectively positionable stop members located adjacent to the side plates. The stop members are movable into a limiting position for engagement with the motor assembly where lateral movement of the motor assembly from the middle position is more limited.

In the preferred form, the base structure is provided with through slot means below the positioning means. Thus, material removed from the frame members and forming the grooves is able to pass downwardly through the slot means and thus leave the positioning means unobstructed.

There is also clamping means to secure the frame members at the operating locations. The clamping means comprises a clamping member movable downwardly and moderately forwardly to come into clamping engagement with the frame members. Thus, the frame members are urged forwardly into proper engagement with the positioning means. In the preferred form, the clamping means comprises a downwardly extending screw member having a moderate forward slant. Further, the clamping means comprises laterally extending finger means threadedly mounted to the screw member so as to be vertically movable by rotation of the screw member.

The preferred form of the base structure is such that there is a centrally positioned, longitudinally extending positioning plate extending upwardly from an upper positioning surface of the base member. The positioning plate presents oppositely facing side surfaces which comprise a portion of the locating surface means. The side surfaces are positioned to engage the frame members on opposite sides of the positioning plate so as to position the frame members laterally. The upper positioning surface of the base surface is substantially unobstructed in laterally outward directions from the positioning plate so that frame members of varying width dimensions can be properly positioned against the side surfaces of the positioning means and on said upper positioning surface.

In the method of the present invention, an apparatus is provided as described above. A pair of frame members are positioned at the operating locations on the base member and moved into engagement with the positioning means. During this time, the motor assembly is at its middle location, with the bit member being positioned between the end portions of the frame members. The motor is turned on to rotate the bit, and the motor assembly is moved first to one side and then to the other to form the grooves in the end members. Also, in the preferred form, the clamping means is moved downwardly to engage the frame members to secure them at the operating locations.

Other features will become apparent from the following Detailed Description.

DETAILED DESCRIPTION OF THE PREFERRED EMBODIMENT

The apparatus 10 of the present invention is particularly designed to form grooves in the mitred ends of frame members which are to be joined to form a picture frame, such as a rectangular picture frame. It is believed that a clearer understanding of the present invention would be obtained by first discussing, at least briefly, the end product (i.e. a picture frame) and the frame members which are formed by use of the present invention.

Figure 5:
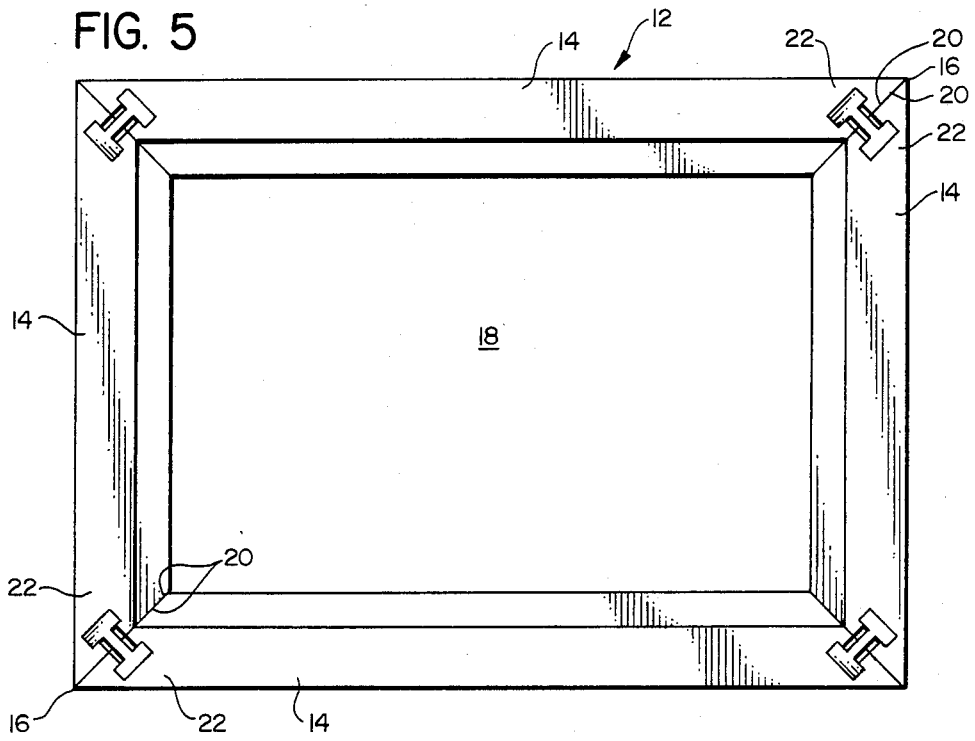
FIG. 5 is a plan view of a picture frame where the four members of the frame have been formed with grooves by the machine of the present invention, and fasteners have been placed in matching sets of grooves to join the frame members and form a picture frame.
Figure 6:
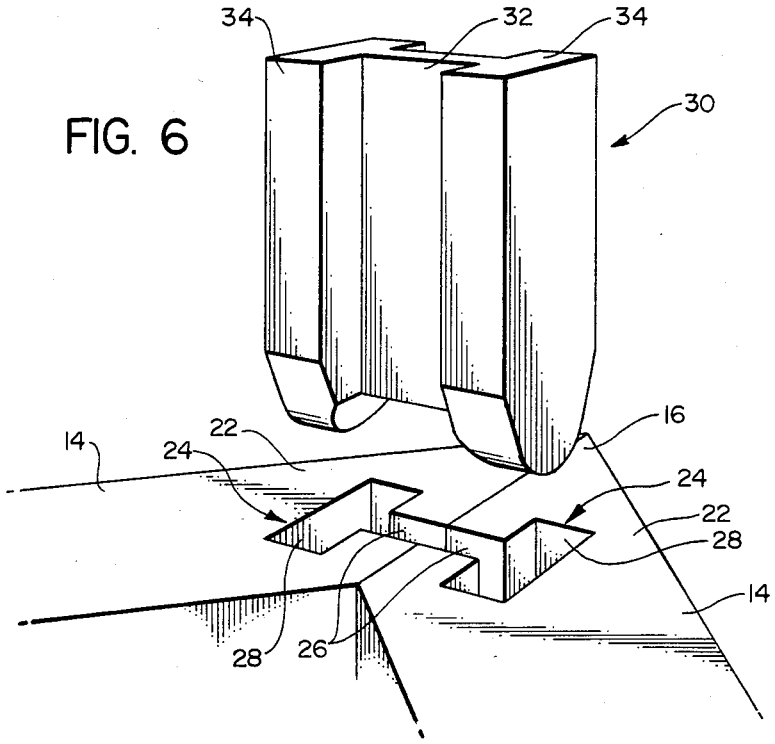
FIG. 6 is an isometric view showing one of the corner joints of the frame of FIG. 5, with the fastener about to be inserted into matching grooves to join the two frame members together at the corner location.

With reference to FIGS. 5 and 6, there is shown a picture frame 12 having side top and bottom frame members 14, which are joined at corner locations 16 and form an enclosed frame area 18. Each frame member 14 has a mitred end surface 20 which is generally formed at an angle of about 45 degrees to the lengthwise axis of its related frame member 14. The mitred end portion 22 of each frame member is formed with a "T" slot 24 having a leg portion 26 and a cross portion 28. These "T" slots 24 are so arranged that when two frame members are positioned with their mitred surfaces 20 abutting one another, the two grooves or slots 24 jointly form an "H" shaped recess.

To join two frame members 14 together, there is provided a connector 30 which in horizontal section has an "H" configuration, comprising a central web portion 32 and two end cross members 34. The precise configuration of this connector 30, in combination with the slots 24, is the subject matter of a second patent application which is to be filed subsequently to the present patent application. It can readily be seen in FIG. 6 that the two frame members 14 can be joined together by placing the mitred surfaces 20 against one another and moving the connector 30 downwardly into the recess 24—24, so that the two cross members 34 of the connector 30 enter into the cross portions 28 of the slots 24 and hold the members 14 and 16 together.

To proceed now with a description of the present invention, the apparatus 10 of the present invention comprises a base structure 36 and a groove cutting device 38 mounted to the base structure 36. In describing the present invention, the apparatus 10 can be considered as having a front end 40, a rear end 42, a forward-to-rear longitudinal axis 44, a horizontal lateral axis 46 and a vertical axis 48.

The base structure 36 has in transverse section, a generally rectangular configuration and comprises a top plate 50 and two side plates 52. Extending upwardly from the top plate 50 is a longitudinally extending positioning plate 54 having a clamping device 56 mounted to the forward end of the plate 54. The upper surface 58 of the top plate 50 and the two side surfaces 60 of the positioning plate 54 define two longitudinally extending positioning means for two frame members 14.

Figure 1:
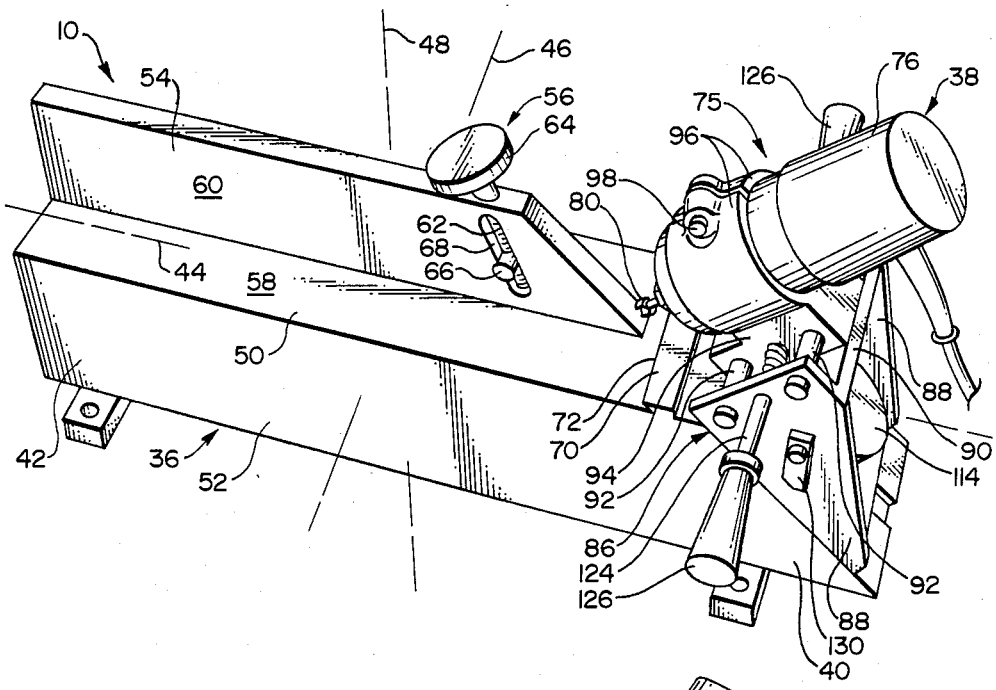
FIG. 1 is an isometric view of the groove cutting machine of the present invention, taken from an upward forward location off to one side.
Figure 2:
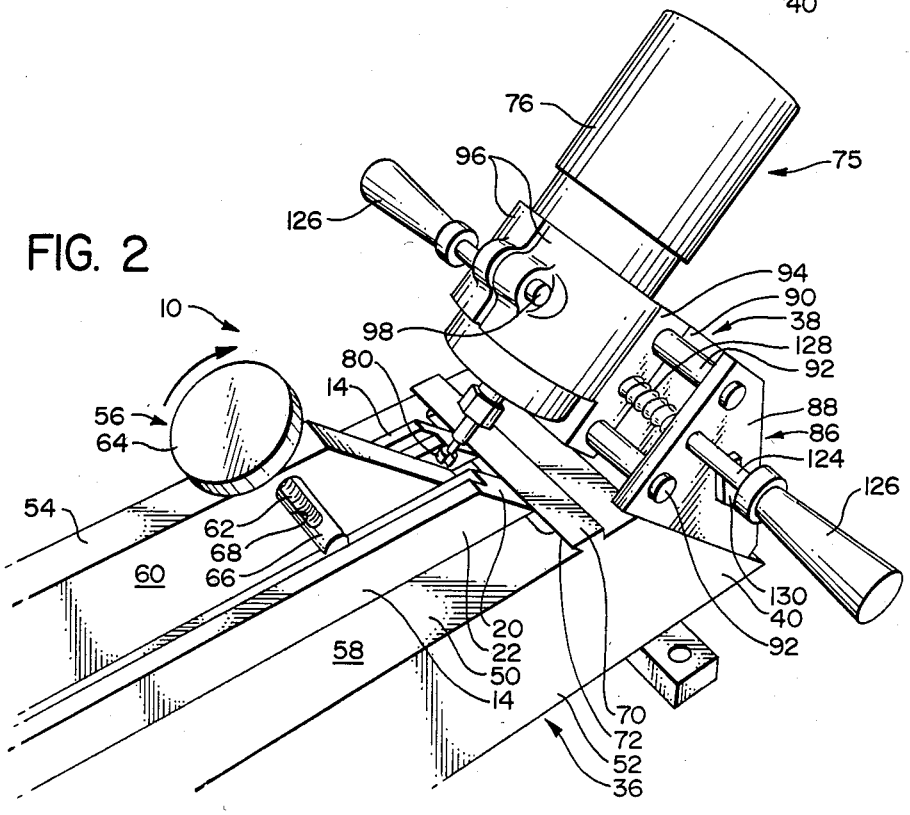
FIG. 2 is an isometric view of the present invention, taken from an upper side location and looking forwardly toward the forward end of the machine of the present invention.

The clamping device 56 comprises an actuating screw 62 which is rigidly connected to an upper rounded handle 64, with the actuating screw 62 extending downwardly from the handle 64 at a moderate forward slant. There is a clamping member or finger 66 which extends through a slot 68 formed in the positioning plate 54, with this slot 68 being aligned with the screw 62. The clamping finger 66 has a generally cylindrical configuration, and the middle of the clamping finger 66 is formed with a threaded through opening to receive the screw 62. The two end portions of the finger 66 extend through the slot outwardly beyond both side surfaces 60 of the positioning plate 54. It is apparent that by rotating the handle 64, the finger 66 can be caused to move upwardly and downwardly in response to rotation of the screw 62, with the downward movement of the finger 66 bringing the finger 66 into clamping engagement with frame members 14, as seen in FIG. 2.

At the forward end of the base structure 36, there is a laterally extending positioning member 70 which extends above the upper surface 58 a short distance and has a rearwardly extending positioning surface 72, angled in an upward and rearward direction at a 45 degree angle so as to be able to properly engage the mitred surfaces 20 of two frame members 14.

Figure 3:
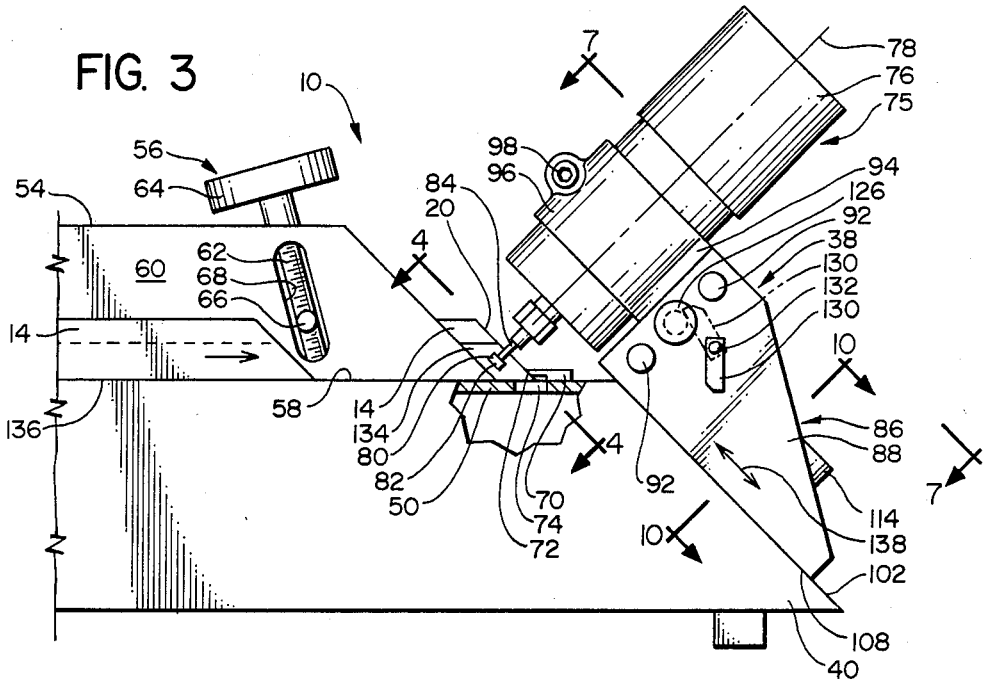
FIG. 3 is a side elevational view of the forward part of the present invention, showing the mitred end of a frame member being moved forwardly into its erating position.

As illustrated in FIG. 3, the upper plate is formed with a lateral through slot 74 extending across the upper plate 50 beneath the positioning surface 72. The primary reason for this slot 74 is so that as wood shavings or other material is created in forcing the grooves in the frame members 14, this waste material can easily drop through the slot 74. If this slot 74 did not exist, then there is a possibility of this material collecting at the lower edge of the positioning surface 72 so that the frame members 14 would possibly not be properly positioned against the stop surface 72.

The aforementioned groove cutting device 38 comprises a motor assembly 75, comprising a motor 76 having a lengthwise motor axis 78 about which the motor components rotate, with a router bit 80 mounted to the front end of the motor 76 so as to be rotatable about the axis 78 (See FIG. 3). This router bit 80 is, or may be, of conventional design, and it is shaped to cut the "T" shaped slot 24 that is shown in FIG. 6. More particularly, this router bit 80 comprises an expanded end cutting portion 82 that forms the cross portion 28 of the slot 24, and a shank 84 that forms the leg 26 of the slot 24.

The motor 76 is mounted to a frame 86 which is, in turn, mounted to the forward end of the base structure 36. This frame 86 comprises two side plates 88 rigidly interconnected by a cross plate 90. There are upper and lower slide rods 92 rigidly connected to and extending between the side plates 88. A motor mounting block 94 (which is part of the motor assembly 75) is mounted to the rods 92 at a position between the side plates 88 and is arranged for back and forth lateral motion between the side plates 88.

Figure 11:
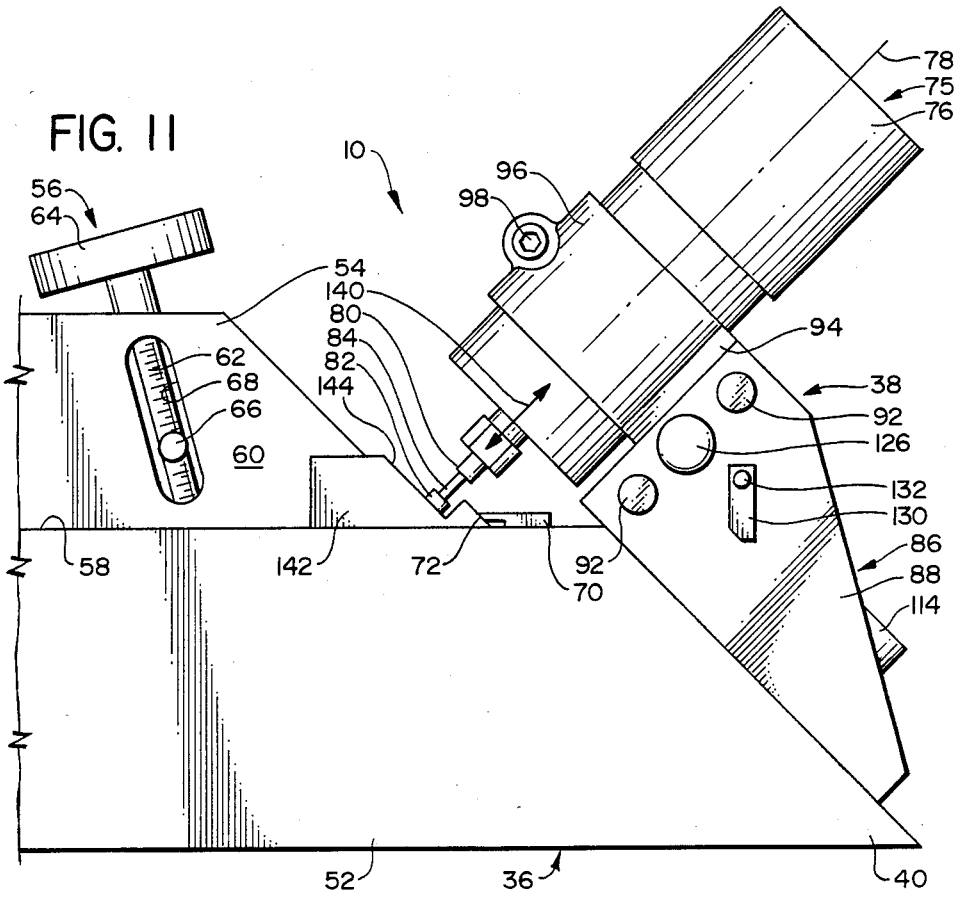
FIG. 11 is a side elevational view of the forward part of the invention, illustrating the manner in which the motor and its router can be adjusted in a direction perpendicular to the plane occupied by the mitred surfaces of the frame members.

The motor mounting block 94 has two upwardly extending circularly curved clamping portions 96 which engage the circular outer surface of the motor 76. The upper ends of the clamping portion 96 are interconnected by a threaded clamping screw 98. This clamping screw 98 is normally threaded into a clamping position to rigidly hold the motor 76 in place. However, by loosening the clamping screw 98, the motor 76 can be moved along its longitudinal axis, as illustrated in FIG. 11, so as to adjust the location of the router bit 80 relative to the stop member 70. This feature will be discussed later.

Figure 10:
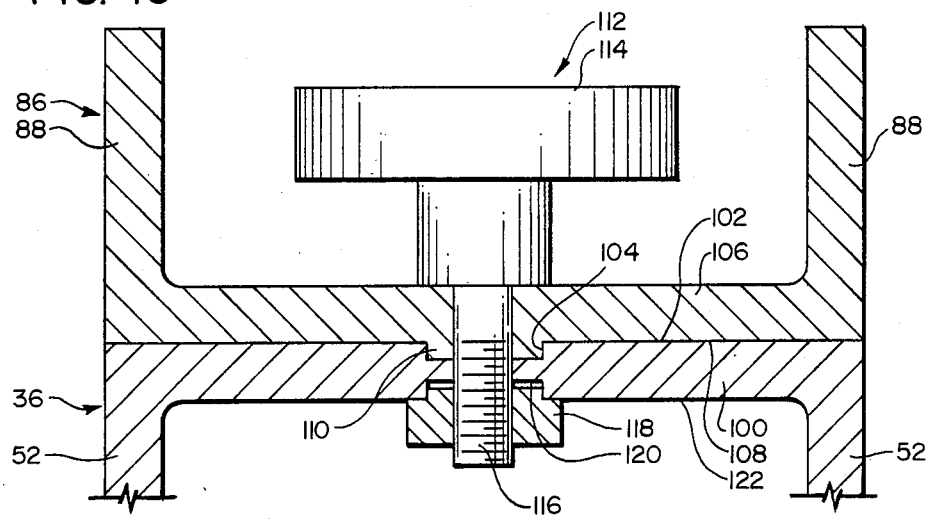
FIG. 10 is a view taken along line 10—10 of FIG. 3, illustrating a clamping device to position the motor and router relative to the base frame.

The mounting frame 86 for the motor assembly 75 is arranged so that it can be moved along an upwardly and rearwardly slanted path relative to the base structure 36. More specifically, as shown in FIG. 10, the base structure 36 has a forward plate 100 having a rearwardly facing mounting surface 102 which extends upwardly and rearwardly at a 45 degree angle. The plate 100 has its surface 102 formed with a center slot 104 extending from the lower end to the upper end of the plate 100.

The mounting frame 86 has a second cross plate 106 having a downwardly and forwardly facing mounting surface 108 which fits against the mounting surface 102. This cross plate 106 has a downwardly extending portion 110 which fits in tongue and groove relationship with the slot 104. As illustrated in FIG. 10, and also in FIG. 3, it is readily apparent that the mounting frame 86 can be moved in an upward and rearward direction, and also in a downward and forward direction relative to the base structure 36.

To hold the mounting frame 86 in any particular location, there is provided a clamping member 112 (See FIG. 10), comprising a rounded rotatable handle 114 positioned above the upper surface of the cross plate 106. This handle 114 is connected to a downwardly extending screw member 116 which engages a nut 118 that is positioned in a slot 120 formed in the lower rearwardly facing surface 122 of the forward plate 110 of the base structure 36. It is readily apparent that by rotating the handle 114 to turn the screw 116 relative to the nut 118, the frame 86 can be clamped firmly to the base structure plate 100, and the handle 114 can be moved to release the frame 86 so that it can be adjusted to a more upward and rearward position or to a more downward and forward position.

To move the motor 76 from side-to-side in the frame 86, there is provided an operating rod 124 which extends through both side plates 88 of the frame 86, with the middle portion of the rod 124 fixedly connected to the motor mounting block 94. Operating handles 126 are connected to opposite ends of the rod 124 so that these handles 126 can conveniently be grasped in the person's right and left hands. A pair of compression springs 128 are mounted around the rod 124 directly adjacent to and on opposite sides of the motor mounting block 94, so that each spring 128 is positioned between the motor mounting block 94 and a related side plate 88 of the frame 86. Thus, the springs 128 urge the motor assembly 75 to a central position, while permitting the motor assembly 75 to be moved to one side or the other by the person grasping the handles 126 and exerting a lateral force thereon.

Figure 7:
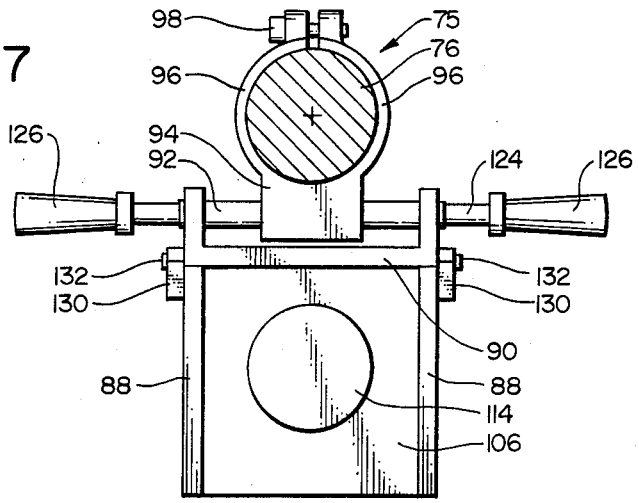
FIG. 7 is a view taken along line 7—7 of FIG. 3, illustrating the motor which carries the router at an intermediate location.
Figure 8:
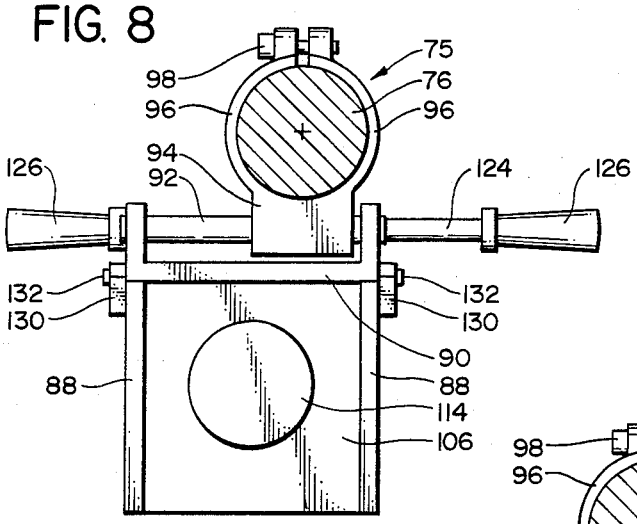
FIG. 8 is a view similar to FIG. 7, showing the motor having been moved to one side location to form a groove in one frame member.
Figure 9:
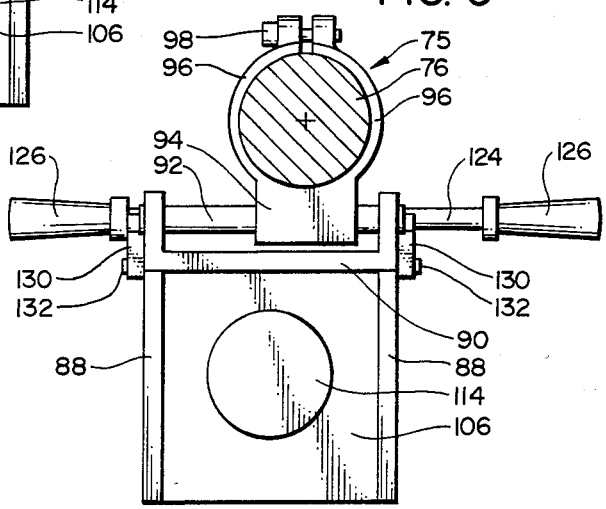
FIG. 9 is a view similar to FIGS. 7 and 8, showing the motor and router being moved to the right to form a groove in the frame member, but with a stop member limiting the lateral movement of the motor.

With reference to FIGS. 7 through 9, it can be seen that in FIG. 7, the motor assembly 75 is centrally positioned between the side plates 88. In FIG. 8, the motor assembly 75 has been moved to an extreme right hand position, with the lateral movement of the motor 76 being limited by engagement of the left handle 126 with the left side plate 88. So that the limit of lateral travel of the motor 76 can be adjusted, selectively operable stop members 130 are positioned along the outside surfaces of the side plates 88. More specifically, each stop member 130 is pivotally mounted to its related side plate 88 at a pivot location 132 so that the stop member can be moved from a downwardly extending non-engaged position (See FIGS. 3, 7 and 8) upwardly to rest on the rod 124 (as shown in broken lines in FIG. 3 and in full lines in FIG. 9) so that the stop member 130 is positioned between its related handle 126 and the adjacent side plate 88. By selectively positioning the stop members 132 in their engaging or nonengaging positions, the lateral movement of the motor 76 can be controlled so as to control the depth of cut made by the router bit 80. While only one set of stop members 130 are shown, there could be more such members 130 for fine adjustment.

Figure 4:
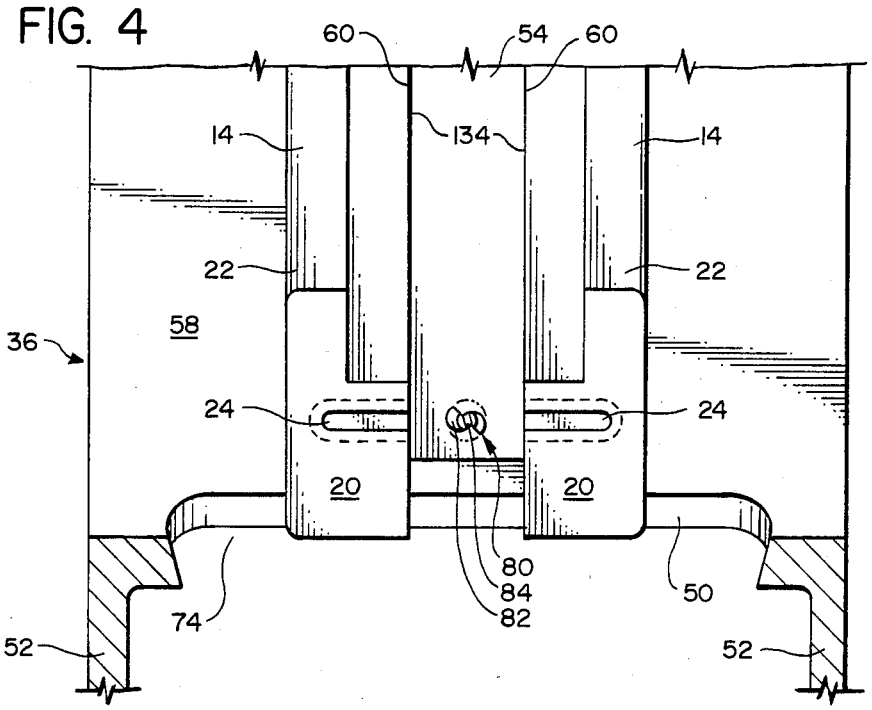
FIG. 4 is a view taken along line 4—4 of FIG. 3, looking along a line perpendicular to the mitred end surfaces of two frame members in their operating position.

To describe the operation of the present invention, let it be assumed that the four frame members 14 of the picture frame 12 have been cut to the desired length, with the end portions 22 of each frame member 14 being cut at a 45 degree angle to form the mitred contact surfaces 20. Two of the frame members 14 which are to be joined to one another at a corner location 16 are positioned on the base structure 36 on opposite sides of the positioning plate 54. As shown in FIG. 4, the side surfaces 60 of the positioning plate 54 are spaced from one another by a distance which is moderately larger than the diaxeter of the end cutting portion 82 of the router bit 80. Thus, with the motor assembly 75 being centrally positioned, the mitred ends 22 of the two frame members 14 can be positioned on opposite sides of the router bit 80. More particularly, the back surface 134 of each frame member 14 is in contact with the adjacent side surface 60 of the positioning plate 54, with the outside surface 136 of each frame member 14 resting on the upwardly facing surface 58 of the top plate 50 of the base structure 36.

The two frame members 14 are pushed forwardly until the lower part of the mitred surface 20 engages the stop surface or positioning surface 72. As indicated previously, the through slot 74 beneath the stop surface 72 permits wood shavings or other foreign matter to simply drop away from the surface 72 and through the slot 74 so as to prevent any obstruction to the proper positioning of the mitred surfaces 20 against the stop surface 72.

When the frame members 14 are properly positioned on the base structure 36, the handle 64 of the clamping device 56 is rotated to move the finger 66 downwardly and forwardly to a moderate degree, to engage the upper surfaces of the frame members 14 and hold them in place. Since the travel of the clamping finger 66 has a moderate forward slant, the clamping action ensures that there is firm engagement of the mitred surfaces 20 of the frame members 14 against the stop surface 72.

With the frame members thus clamped in place, the motor 76 is supplied with power to rotate the router bit 80. Then the operator grasps the two operating handles 126 (one in each hand) and simply moves the motor assembly 75, first to one side, and then to the other, so that the appropriate groove 24 is formed in the end portion 22 of one of the frame members 14 and then a groove 24 is formed in the other frame member 14. If the stop members 130 are in their disengaged position (See FIG. 8), the travel of the motor assembly 75 is greater, thus forming a deeper groove 24. On the other hand, if the stop members 130 are positioned in their engaging position as shown in FIG. 9, then the lateral travel of the motor assembly 75 is less, and the grooves 24 are of less depth.

On completion of the cutting operation, the clamping handle 64 is moved to disengage the clamping finger 66 from the frame members 14 to permit these frame members 14 to be removed. Then a second set of frame members 14 are placed onto the base structure 36, with the same operation being repeated.

In the event that it is desired to adjust the location of the groove 24 formed in the frame member 14, as shown in FIG. 3, the mounting frame 86 can be adjusted in the direction indicated by the arrow 138 (either upwardly and rearwardly or downwardly and forwardly). This is accomplished by rotating the handle 114 to release the nut 118 from its clamping position, so that the frame 86 can have its position adjusted. Then the handle 114 is simply rotated back to its clamping position.

The setting of the router bit 80 in a downward and forward direction is critical, since it is essential that the length of the leg portions 26 of the two slots 24 be made very precisely so that the slots 24 properly fit with the connector 30. Accordingly, as illustrated in FIG. 11, there is provided a locating die 142 that is moved into engagement with the positioning member 70. This locating die 142 has a forwardly facing contact surface 144 that is positioned directly rearwardly of the router bit 80 when the motor 76 is in its middle position. The screw 98 is loosened so that the motor 76 can be adjusted along the motor axis 78 as indicated by the arrow 140 in FIG. 11. When the end of the router bit 80 is in contact with the locating die surface 144, the bit 80 is properly positioned, and the screw 98 can be tightened to clamp the arms 96 securely around the motor 76. Once the position of the router bit 80 is set, this is normally not changed.

It is to be understood that various modifications could be made to the present invention without departing from the basic teachings thereof.

What is claimed is:

1. An apparatus to form grooves in a pair of first and second frame members, each of which has a mitred end with an end surface slanted at an acute angle to a lengthwise axis of the frame member, said apparatus having a longitudinal axis, a lateral axis, a vertical axis, a front end and a rear end, said apparatus comprising:

a. a base structure having upwardly facing and laterally facing locating surface means defining first and second operating locations where said first and second frame members can be located to be in contact with said surface means so as to position said frame members relative to said vertical and lateral axes in said first and second operating locations, with the end surfaces of the frame members being at forward locations facing upwardly and forwardly, and with the frame members being spaced from one another by a predetermined lateral spacing distance;

b. positioning means mounted proximate to the forward end of the base structure to engage the end portions of the frame members to locate the frame members along the longitudinal axis at the operating locations;

c. a groove forming motor assembly comprising a motor and a bit member, with the bit member being mounted to the motor for rotation about an operating axis slanting downwardly and forwardly, generally perpendicular to a plane occupied by the end surfaces of the frame members;

d. a mounting frame having laterally oriented slide mounting means to which said motor assembly is mounted for lateral movement in either direction from a middle location, the motor assembly being characterized in that when said motor assembly is at the middle location, the bit member is positioned between the end portions of the frame members when in their operating positions;

e. spring means operatively engaged between the frame member and the motor assembly to yieldingly hold the motor assembly in the middle position, and move the motor assembly back to the middle position after lateral displacement of the motor assembly; and f. said mounting frame being adjustably mounted to said base structure for positional adjustment along an adjustment axis extending upwardly and rearwardly at the front end of the base structure, whereby first and second frame members can be placed on the base structure at the first and second operating locations, with the motor assembly being centrally positioned, and the motor assembly can then be moved laterally from the center position to form the grooves in the frame members.

2. The apparatus as recited in claim 1, wherein said motor has a downwardly and rearwardly extending motor axis, and said motor is mounted to said mounting frame so as to be adjustable along said motor axis.

3. The apparatus as recited in claim 1, wherein said motor assembly comprises handle means adapted to be grasped manually and moved laterally to move said motor assembly from the middle position.

4. The assembly as recited in claim 3, wherein said mounting frame has laterally spaced side plates between which said slide mounting means is positioned, with said motor being positioned between said side plates, said spring means comprising compression spring members positioned on opposite sides of said motor and between said side plates.

5. The apparatus as recited in claim 4, further comprising selectively positionable stop members located adjacent said side plates, with said stop members being movable into a limiting position for engagement with said motor assembly where lateral movement of said motor assembly from the middle position is more limited.

6. The apparatus as recited in claim 1, wherein said base structure is provided with through slot means below said positioning means, whereby material removed from said frame members in forming said grooves is able to pass downwardly through said slot means and thus leave said positioning means unobstructed.

7. The apparatus as recited in claim 1, further comprising clamping means to secure the frame members at said operating locations, said clamping means comprising a clamping member movable downwardly and moderately forwardly to come into clamping engagement with said frame members, whereby said frame members are urged forwardly into proper engagement with the positioning means.

8. The apparatus as recited in claim 7, wherein said clamping means comprises a downwardly extending screw member having a moderate forward slant, and said clamping member comprises laterally extending finger means threadedly mounted to said screw member so as to be vertically movable by rotation of said screw member.

9. The apparatus as recited in claim 1, wherein said base structure further comprises a centrally positioned, longitudinally extending positioning plate extending upwardly from an upper positioning surface of said base member, said positioning plate presenting oppositely facing side surfaces which comprise a portion of said locating surface means, said side surfaces being positioned to engage said frame members on opposite sides of said positioning plate so as to position said frame members laterally, the upper positioning surface of the base structure also comprising said locating surface means and being substantially unobstructed in laterally outward directions from said positioning plate so that frame members of varying width dixensions can be properly positioned against the side surfaces of the positioning plate means and on said upper positioning surface.

10. The apparatus as recited in claim 1, wherein:

a. said mounting frame has laterally spaced side plates between which said slide mounting means is positioned, with said motor being positioned between said side plates, said spring means comprising compression spring members positioned on opposite sides of the motor and between the side plates; and b. there is selectively positionable stop members located adjacent said side plates, with said stop members being movable into a limiting position for engagement with said motor assembly where lateral movement of said motor assembly from the middle position is more limited.

11. The apparatus as recited in claim 1, wherein:

a. said base structure is provided with through slot means below said positioning means, whereby material removed from the frame members in forming said grooves is able to pass downwardly through the slot means and thus leave said positioning means unobstructed;

b. there is clamping means to secure the frame members at the operating locations, said clamping means comprising a clamping member movable downwardly and moderately forwardly to come into clamping engagement with said frame members, whereby said frame members are urged forwardly into proper engagement with the positioning means; and c. said base structure further comprises a centrally positioned, longitudinally extending positioning plate extending upwardly from an upper positioning surface of said base member, said positioning plate presenting oppositely facing side surfaces which comprise a portion of said locating surface means, said side surfaces being positioned to engage said frame members on opposite sides of said positioning plate so as to position said frame members laterally, the upper positioning surface of the base structure also comprising said locating surface means and being substantially unobstructed in laterally outward directions from said positioning plate so that frame members of varying width dixensions can be properly positioned against the side surfaces of the positioning plate means and on said upper positioning surface.

12. An apparatus to form grooves in a pair of first and second frame members, each of which has a mitred end with an end surface slanted at an acute angle to a lengthwise axis of the frame member, said apparatus having a longitudinal axis, a lateral axis, a vertical axis, a front end and a rear end, said apparatus comprising:

a. a base structure having upwardly facing and laterally facing locating surface means defining first and second operating locations where said first and second frame members can be located to be in contact with said surface means so as to position said frame members relative to said vertical and lateral axes in said first and second operating locations, with the end surfaces of the frame members being at forward locations facing upwardly and forwardly, and with the frame members being spaced from one another by a predetermined lateral spacing distance;

b. positioning means mounted proximate to the forward end of the base structure to engage the end portions of the frame members to locate the frame members along the longitudinal axis at the operating locations;

c. a groove forming motor assembly comprising a motor and a bit member, with the bit member being mounted to the motor for rotation about an operating axis slanting downwardly and forwardly, generally perpendicular to a plane occupied by the end surfaces of the frame members;

d. a mounting frame having laterally oriented slide mounting means to which said motor assembly is mounted for lateral movement in either direction from a middle location, the motor assembly being characterized in that when said motor assembly is at the middle location, the bit member is positioned between the end portions of the frame members when in their operating positions;

e. said base structure further comprising a centrally positioned, longitudinally extending positioning plate extending upwardly from an upper positioning surface of said base member, said positioning plate presenting oppositely facing side surfaces which comprise a portion of said locating surface means, said side surfaces being positioned to engage said frame members on opposite sides of said positioning plate so as to position said frame members laterally, the upper positioning surface of the base structure also comprising said locating surface means and being substantially unobstructed in laterally outward directions from said positioning plate so that frame members of varying width dimensions can be properly positioned against the side surfaces of the positioning plate means and on said upper positioning surface, whereby first and second frame members can be placed on the base structure at the first and second operating locations, with the motor assembly being centrally positioned, and the motor assembly can then be moved laterally from the center position to form the grooves in the frame members.

13. The apparatus as recited in claim 12, wherein said base structure is provided with through slot means below said positioning means, whereby material removed from said frame members in forming said grooves is able to pass downwardly through said slot means and thus leave said positioning means unobstructed.

14. The apparatus as recited in claim 12, further comprising clamping means to secure the frame members at said operating locations, said clamping means comprising a clamping member movable downwardly and moderately forwardly to come into clamping engagement with said frame members, whereby said frame members are urged forwardly into proper engagement with the positioning means.

15. The apparatus as recited in claim 14, wherein said clamping means comprises a downwardly extending screw member having a moderate forward slant, and said clamping member comprises laterally extending finger means threadedly mounted to said screw member so as to be vertically movable by rotation of said screw member.

16. The apparatus as recited in claim 12, wherein said motor assembly comprises handle means adapted to be grasped manually and moved laterally to move said motor assembly from the middle position.

17. The assembly as recited in claim 12, wherein said mounting frame has laterally spaced side plates between which said slide mounting means is positioned, with said motor being positioned between said side plates, spring means comprising compression spring members positioned on opposite sides of said motor and between said side plates.

18. The apparatus as recited in claim 17, further comprising selectively positionable stop members located adjacent said side plates, with said stop members being movable into a limiting position for engagement with said motor assembly where lateral movement of said motor assembly from the middle position is more limited.

19. A method to form grooves in a pair of first and second frame members, each of which has a mitred end with an end surface slanted at an acute angle to a lengthwise axis of the frame member:

a. providing an apparatus having a longitudinal axis, a lateral axis, a vertical axis, a front end and a rear end, said method comprising:

b. placing said frame members against upwardly facing and laterally facing locating surface means of a base structure of said apparatus at first and second operating locations where said first and second frame members are located to be in contact with said surface means so as to position said frame members relative to said vertical and lateral axes in said first and second operating locations, with the end surfaces of the frame members being at forward locations facing upwardly and forwardly, and with the frame members being spaced from one another by a predetermined lateral spacing distance;

c. locating said frame members against positioning means mounted proximate to the forward end of the base structure which engage the end portions of the frame members to locate the frame members along the longitudinal axis at the operating locations;

d. providing a groove forming motor assembly comprising a motor and a bit member, with the bit member being mounted to the motor for rotation about an operating axis slanting downwardly and forwardly, generally perpendicular to a plane occupied by the end surfaces of the frame members, and operating said motor to cause rotation of said bit member;

e. providing a mounting frame having laterally oriented slide mounting means to which said motor assembly is mounted, positioning the motor assembly at a middle location where the bit member is positioned between the end portions of the frame members, and then moving the motor assembly laterally in opposite directions to form grooves in the first and second frame members; and f. said method being further characterized in that said base structure further comprises a centrally positioned, longitudinally extending positioning plate extending upwardly from an upper positioning surface of the base member, said positioning plate presenting oppositely facing side surfaces which comprise a portion of the locating surface means, said method further comprising positioning the frame members on opposite sides of the positioning plate so as to position the frame members laterally, with the upper positioning surface of the base structure also comprising said locating surface means and being substantially unobstructed in laterally outward directions from the positioning plate so that frame members of varying width dixensions can be properly positioned against the side surfaces of the positioning plate means and on the upper positioning surface.

20. The method as recited in claim 19, wherein said base structure is provided with through slot means below said positioning means, said method further comprising causing material removed from said frame members in forming said grooves to pass downwardly through said slot means and thus leave said positioning means. unobstructed.

* * * * *